US005727686A

United States Patent [19]

Kristal

[11] Patent Number: 5,727,686

[45] Date of Patent: Mar. 17, 1998

[54] TAMPER-EVIDENT SECURITY ENVELOPES

[76] Inventor: Boaz Kristal, Menachem Begin Street 8/27, Ramat Poleg, Natanya, Israel

[21] Appl. No.: 508,429

[22] Filed: Jul. 31, 1995

[51] Int. Cl.[6] ..... B65D 85/00

[52] U.S. Cl. ..... 206/459.1; 206/459.5; 206/807; 229/68.1; 53/374.2; 53/411; 53/131.4; 53/562; 383/5; 156/581

[58] Field of Search ..... 206/63.3, 459.1, 206/459.5, 438, 484, 807; 383/5; 229/68.1; 53/131.4, 131.5, 374.2, 410, 411, 455, 562, 570; 156/580, 581

[56] References Cited

U.S. PATENT DOCUMENTS

| | | | |
|---|---|---|---|
| D. 162,694 | 3/1951 | Salfisberg | 206/484 |
| 2,230,849 | 2/1941 | Salfisberg | 206/484 |
| 2,325,021 | 7/1943 | Salfisberg | 206/484 |
| 2,545,243 | 3/1951 | Ramsey, Jr. | 53/411 |
| 2,685,911 | 8/1954 | Haller | 156/181 |
| 3,043,506 | 7/1962 | Bremer | 229/68.1 |
| 3,372,797 | 3/1968 | Grevich | 206/484 |
| 3,745,919 | 7/1973 | Wattenburg et al. . | |
| 3,899,073 | 8/1975 | Barr | 206/459.5 |
| 4,860,899 | 8/1989 | McKee | 206/459.5 |
| 5,060,848 | 10/1991 | Ewan | 206/459.1 |
| 5,137,304 | 8/1992 | Silverschotz et al. | 53/411 |
| 5,161,687 | 11/1992 | Kornell et al. | 206/459.5 |
| 5,323,908 | 6/1994 | Boettger | 206/534 |

*Primary Examiner*—David T. Fidei
*Attorney, Agent, or Firm*—Mark M. Friedman

[57] ABSTRACT

A tamper-evident envelope has a first layer of paper-containing material and a second layer of paper-containing material attached to each other along a number of seams. Each seam includes a pattern embossed and/or perforated through both layers along a major part of the seam. If the envelope is opened and resealed along one of these seams, the embossed or perforated pattern is corrupted, thereby making the unauthorized opening of the envelope readily apparent to an intended recipient.

22 Claims, 4 Drawing Sheets

FIG. 4
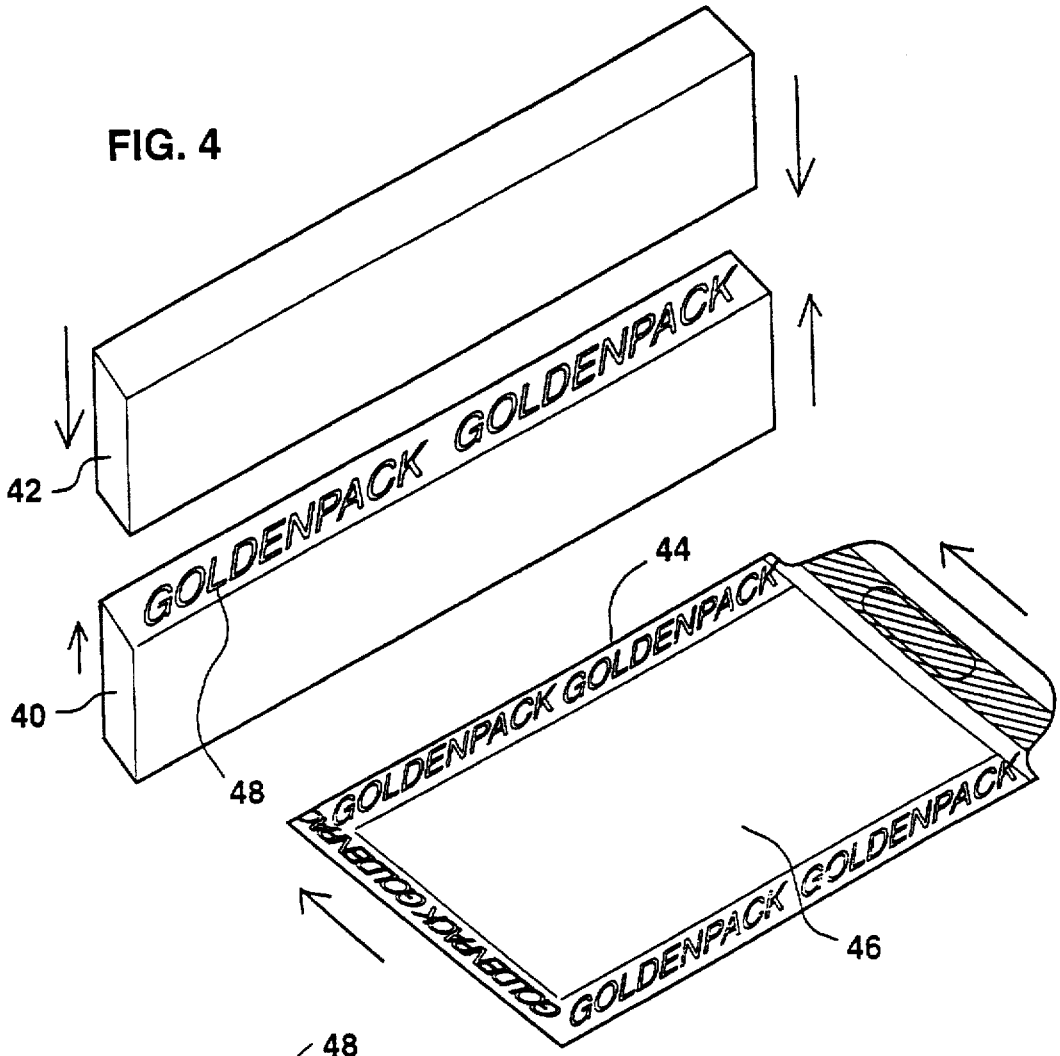
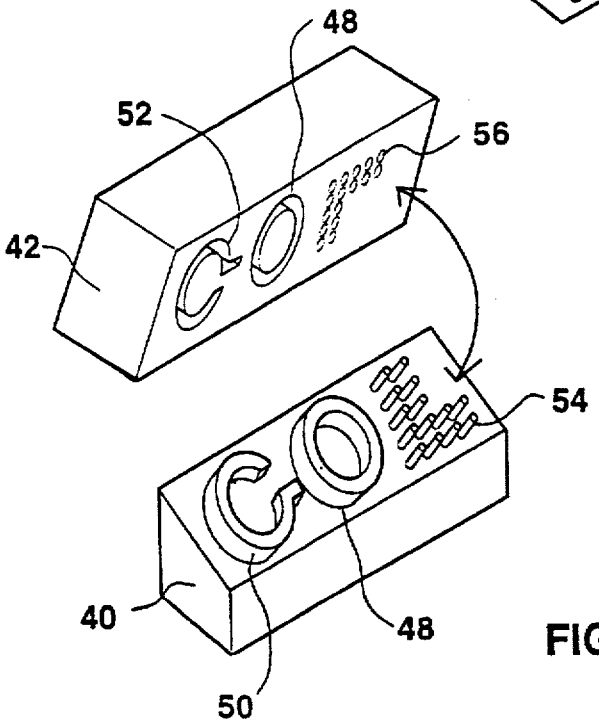
FIG. 5

TAMPER-EVIDENT SECURITY ENVELOPES

FIELD AND BACKGROUND OF THE INVENTION

The present invention relates to tamper-proof packaging and, in particular, to envelopes which provide a tamper-evident seal which reveals if the envelopes have been opened and resealed.

It is known to provide tamper-proof or, perhaps more accurately, tamper-evident seals for envelopes and the like. The principle of such seals dates back many centuries to the use of sealing-wax stamped with a signet ring to guarantee the authenticity and confidentiality of important documents.

Modern envelopes and envelope-type packages provide only a limited degree of tamper-evident protection. Typically, they are made from one folded, or two flat, sheets of paper or cardboard, glued to form a rectangular enclosure. One edge of the envelope is provided with a pre-gummed flap which is sealed by a user after the contents of the envelope are in place. Once sealed, careless opening by an unauthorized party may result in tearing of the envelope which would be visible to the recipient. However, a more sophisticated approach using heat and/or moisture allows glued seams to be opened and resealed undetectably, without damage to the envelope.

Use of stronger glues provides somewhat improved tamper-evident protection by increasing the chances that the envelope will be turn on opening. However, there remains a possibility that the glue itself may be cut and resealed undetectably. Furthermore, a determined tamperer may cut away an entire seam to access the contents of the envelope, and then forge a replacement seam.

In the context of other types of packaging, various products for providing tamper-evident seals are available. One example of such a product is "Tamper Evident—VOID" produced by 3M, commonly used with plastic boxes in the packaging of magnetic disks. However, the cost and complexity of these products prohibits their use for multiple seams in mass produced envelopes.

It would therefore be beneficial to have a simple, cost-effective method for producing tamper-evident envelopes. There is also a need for envelopes which provide a readily detectible indication of opening, thereby preventing clandestine access to their contents during transit.

SUMMARY OF THE INVENTION

The present invention is of tamper-evident envelopes, and a method of producing them.

According to the teachings of the present invention there is provided, a method of producing a tamper-evident envelope, the method comprising the step of sealing a first layer of paper-containing material to a second layer of paper-containing material along at least one edge to form a tamper-evident seam, the step of sealing including: (a) positioning the first layer against the second layer along the at least one edge; and (b) pressing together the first layer and the second layer along the at least one edge between a male embossing jaw and a female embossing jaw so as to produce a tamper-evident seam having an embossed pattern through both the first and second layers along a major part of the at least one edge.

According to a further feature of the present invention, the male and the female embossing jaws include perforating features such that the step of pressing together produces a tamper-evident seam which includes a pattern of perforations through the first and second layers.

According to a further feature of the present invention, the step of positioning is performed with a glue interposed between the first layer and the second layer along the at least one edge.

According to a further feature of the present invention, the first layer and the second layer each include a polymer lamination, the step of positioning being performed such that the polymer lamination of the first layer abuts the polymer lamination of the second layer, the male embossing jaw and the female embossing jaw being heated such that the step of pressing together causes fusing of the polymer lamination of the first layer with the polymer lamination of the second layer.

According to a further feature of the present invention, the step of sealing is performed along a first substantially straight edge, a second edge substantially parallel to the first edge, and a third edge substantially perpendicular to, and substantially connecting between, the first and second edges, thereby defining a substantially rectangular tamper-evident envelope having a fourth edge which is to be sealed by a user.

According to a further feature of the present invention, the first layer extends beyond the second layer at the fourth edge thereby forming a fold-over flap, the method further comprising the step of providing a tamper-evident, user-sealable means for attaching the fold-over flap to the second layer.

According to a further feature of the present invention, the first and second layers are formed by folding a single sheet of paper-containing material thereby defining a first edge of the tamper-evident envelope along which the first and second layers are joined at a fold, the step of sealing being performed along a second edge substantially perpendicular to, and substantially connecting to, the first edge, and a third edge substantially perpendicular to, and substantially connecting to, one out of the first and the second edges, thereby defining a substantially rectangular tamper-evident envelope having a fourth edge which is to be sealed by a user.

According to a further feature of the present invention, the first layer extends beyond the second layer at the fourth edge thereby forming a fold-over flap, the method further comprising the step of providing a tamper-evident, user-sealable means for attaching the fold-over flap to the second layer.

According to the teachings of the present invention there is also provided, a method of producing a tamper-evident envelope, the method comprising the step of sealing a first layer of paper-containing material to a second layer of paper-containing material along at least one edge to form a tamper-evident seam, the step of sealing including: (a) positioning the first layer against the second layer along the at least one edge; and (b) pressing together the first layer and the second layer along the at least one edge between a male perforating jaw and a female perforating jaw so as to produce a tamper-evident seam having a pattern of holes perforated through both the first and second layers along a major part of the at least one edge.

According to a further feature of the present invention, the male and the female perforating jaws include embossing features such that the step of pressing together produces a tamper-evident seam which includes a pattern embossed through the first and second layers.

According to a further feature of the present invention, the step of positioning is performed with a glue interposed between the first layer and the second layer along the at least one edge.

According to a further feature of the present invention, the first layer and the second layer each include a polymer lamination, the step of positioning being performed such that the polymer lamination of the first layer abuts the polymer lamination of the second layer, the male embossing jaw and the female embossing jaw being heated such that the step of pressing together causes fusing of the polymer lamination of the first layer with the polymer lamination of the second layer.

According to the teachings of the present invention there is also provided, a tamper-evident envelope comprising: (a) a first layer of paper-containing material; and (b) a second layer of paper-containing material attached to the first layer along at least one seam, wherein the at least one seam includes a pattern embossed through both the first and second layers along a major part of the at least one seam.

According to a further feature of the present invention, the at least one seam includes a pattern of holes perforated through both the first and second layers.

According to a further feature of the present invention, the tamper-evident envelope is substantially rectangular having a first edge, a second edge, a third edge and a fourth edge, the at least one seam extending along a major part of each of the first, second and third edges.

According to a further feature of the present invention, the first layer extends beyond the second layer at the fourth edge thereby forming a fold-over flap, the tamper-evident envelope further comprising a tamper-evident, user-sealable means for attaching the fold-over flap to the second layer.

According to a further feature of the present invention, the tamper-evident envelope is substantially rectangular having a first edge, a second edge, a third edge and a fourth edge, the first and second layers being formed from a single sheet of paper-containing material folded along the first edge, the at least one seam extending along a major part of each of the second and third edges.

According to a further feature of the present invention, the first layer extends beyond the second layer at the fourth edge thereby forming a fold-over flap, the tamper-evident envelope further comprising a tamper-evident, user-sealable means for attaching the fold-over flap to the second layer.

According to a further feature of the present invention, the pattern includes a sequence of characters forming a word.

According to a further feature of the present invention, the pattern includes a non-alphanumeric design.

According to the teachings of the present invention there is also provided, a tamper-evident envelope comprising: (a) a first layer of paper-containing material; and (b) a second layer of paper-containing material attached to the first layer along at least one seam, wherein the at least one seam includes a pattern of holes perforated embossed through both the first and second layers along a major part of the at least one seam.

According to a further feature of the present invention, the at least one seam includes a pattern embossed through both the first and second layers.

BRIEF DESCRIPTION OF THE DRAWINGS

The invention is herein described, by way of example only, with reference to the accompanying drawings, wherein:

FIG. 4 is a schematic perspective view of a pair of embossing jaws for use in the production of tamper-evident envelopes, constructed and operative according to the teachings of the present invention;

FIG. 5 is an enlarged schematic perspective view of a part of the pair of embossing jaws of FIG. 4.

DESCRIPTION OF THE PREFERRED EMBODIMENTS

The present invention is of tamper-evident envelopes, and a method of producing them.

The principles and operation of tamper-evident envelopes according to the present invention, and of a method of producing them, may be better understood with reference to the drawings and the accompanying description.

Figure 1:
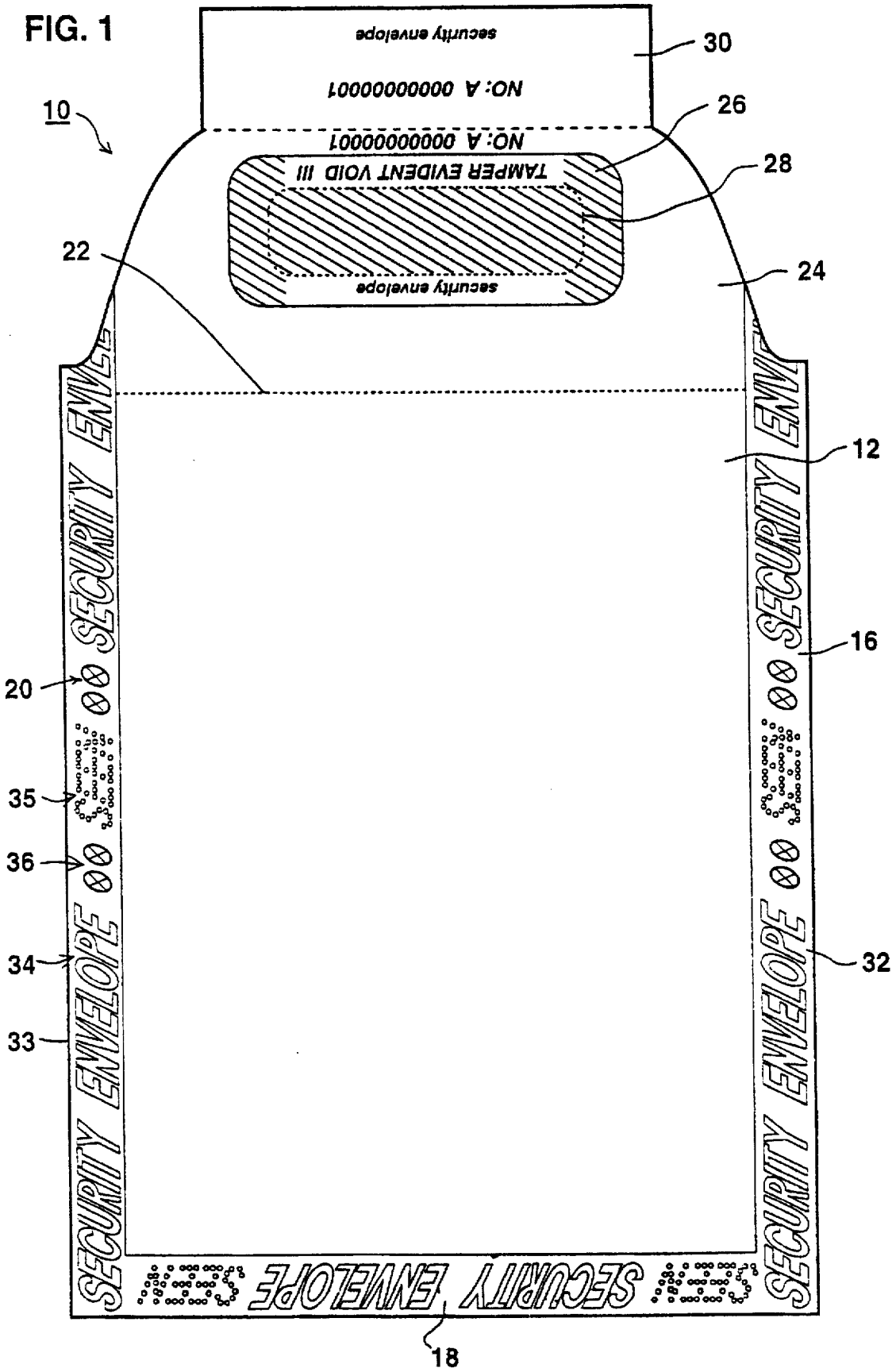
FIG. 1 is a top view of a first embodiment of a tamper-evident envelope, constructed and operative according to the teachings of the present invention.
Figure 2:
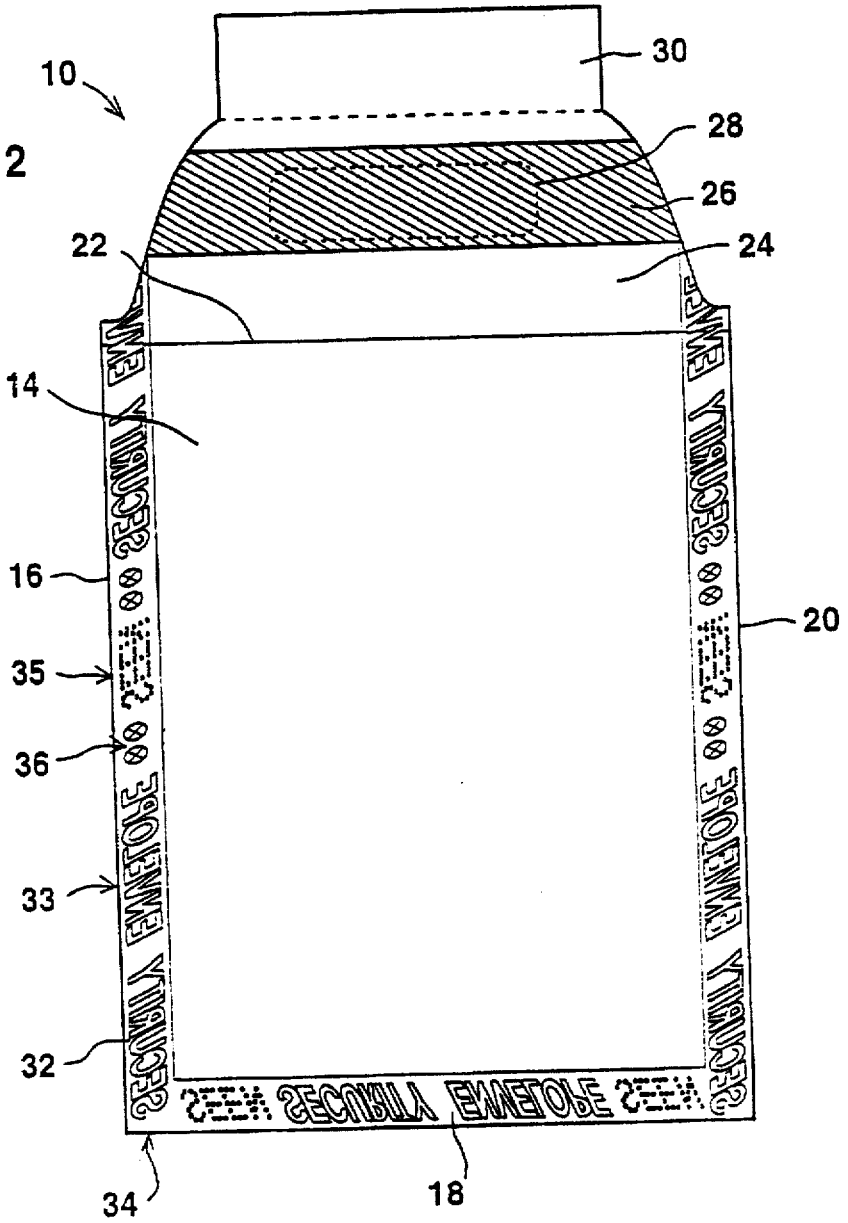
FIG. 2 is a bottom view of the tamper-evident envelope of FIG. 1.

Referring now to the drawings, FIGS. 1 and 2 show a first embodiment of a tamper-evident envelope, generally designated 10, constructed and operative according to the teachings of the present invention. In general terms, tamper-evident envelope 10 has a first layer of paper-containing material and a second layer of paper-containing material attached to each other along a number of seams. Each seam includes a pattern embossed through both layers along a major part of the seam. If envelope 10 is opened and resealed along one of these seams, the embossed pattern is corrupted, thereby making the unauthorized opening of envelope 10 readily apparent to an intended recipient.

The present invention is applicable to a wide range of types and shapes of envelopes and packages including, but not limited to, paper envelopes, padded envelopes, reinforced and stiffened envelopes, and packages made of cardboard. The term "envelope" is used in the specification and claims to refer to any of these and other envelopes and packages.

The phrase "paper-containing material", as used herein in the specification and claims, is taken to mean any material or composite material having a sufficient content of wood pulp or another structurally equivalent component to allow the material to be embossed to form a raised pattern. Examples of such materials include, but are not limited to, paper, cardboard, artificial paper substitutes, and paper lined with metallic or plastics materials.

The phrase "tamper-evident" is used herein as a more precise alternative to the more commonly used phrase "tamper-proof". The present invention does not attempt to prevent opening of an envelope by an unauthorized person. It simply renders the opening obvious to the subsequent recipient of the envelope, thereby alerting the recipient to the danger that the contents may have been read or altered in transit.

Turning now to the features of envelope 10 in more detail, envelope 10 has a first layer 12 and a second layer 14 attached to each other along three edges by seams 16, 18 and 20 to form a rectangular enclosure. Envelope 10 has a fourth edge 22 at which layers 12 and 14 are separable to allow envelope 10 to be filled. First layer 12 extends beyond second layer 14 at fourth edge 22, thereby forming a fold-over flap 24.

Fold-over flap 24 preferably features a tamper-evident, user-sealable adhesive seal 26 for attaching fold-over flap 24 to second layer 14. One example of a seal suitable for this purpose is "Tamper Evident—VOID" produced by 3M. If this or a similar product is used, fold-over flap 24 is provided with a cut-out window 28 so that the indicator panel of the seal is visible. In the case that fold-over flap 24 is relatively wide, a number of separate user-sealable adhesive seals 26 may be spaced across fold-over flap 24. Alternatively, other types of tamper-evident strips, tapes, or other seals may be used.

Fold-over flap 24 may additionally feature a tear-off identification panel 30. Identification panel 30 carries a serial number of envelope 10 so that identification panel 30 may be removed and kept by a user to serve as a record of dispatch. Typically, the same serial number appears in at least one location elsewhere on envelope 10.

The presence of a serial number on each envelope is, in itself, of importance. The serial number enables a recipient to check that the envelope which he has received is the same envelope as was originally sent. In this way, the recipient can detect if the contents of an envelope have been removed from the original envelope and resealed in a replacement envelope similar to the original.

It is a particular feature of the present invention that at least some, and preferably all, of seams 16, 18 and 20 feature a pattern 32 embossed and/or perforated along a major part of their length. Pattern 32 typically includes a sequence of characters 34 forming one or more words. Additionally, or alternatively, pattern 32 may include one or more non-alphanumeric design 36.

Pattern 32 preferably features a first part 33 which is embossed through layers 12 and 14, and a second part 35 which is made up of perforations through layers 12 and 14. The use of both techniques provides additional aspects of tamper-evident protection, as will be described below. Alternatively, pattern 32 may be formed by embossing alone, or by perforation alone.

Figure 3A:
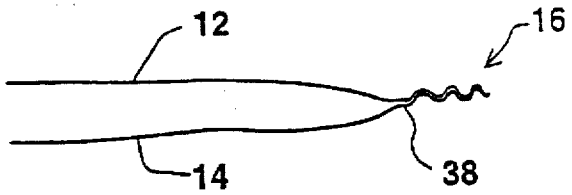
FIG. 3A is a schematic side cross-sectional view through a tamper-evident seam of a tamper-evident envelope, constructed and operative according to the teachings of the present invention.

The structure and significance of seam 16, and hence of seams 18 and 20 which are similar thereto, will now be described in more detail with reference to FIGS. 3A and 3B. FIG. 3A shows layers 12 and 14 attached at seam 16 by a thin layer of glue 38. Glue 38 is preferably a thermoset glue, which hardens irreversibly on cooling and is not readily soluble in non-paper-damaging solvents, as will be described in more detail below. Embossed part 33 of pattern 32 is seen here as a number of step-like raised portions embossed through the entire thickness of seam 16. These step-like raised portions serve to interlock layers 12 and 14.

Seam 16 provides a high degree of tamper-evident protection. Firstly, the combined effect of the interlocking of layers 12 and 14 due to embossed part 33 of pattern 32, and of glue 38, makes it almost impossible to separate layers 12 and 14 along seam 16 without tearing one or both layers. And secondly, even if one succeeded in separating layers 12 and 14 without tearing them, corruption of embossed part 33 of pattern 32 or of the alignment of perforations in perforated part 35 of pattern 32 would enable immediate identification of unauthorized resealing.

Figure 3B:
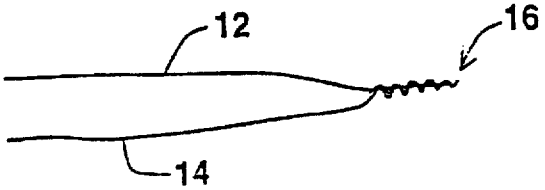
FIG. 3B is a schematic side cross-sectional view through the tamper-evident seam of FIG. 3A after opening and re-sealing.

The effects of an unauthorized attempt to reseal seam 16 on embossed part 33 of pattern 32 are illustrated in FIG. 3B. The embossing is generally flattened by the pressure of resealing without the use of the original embossing jaws. To the extent that the embossing of pattern 32 is preserved, seam 16 is thickened significantly by the presence of embossed patterns in both layers 12 and 14 which cannot be returned to their original interlocked form.

The presence of perforated part 35 in pattern 32 provides additional or alternative protection. The perforations are preferably numerous and small in size, each typically having a diameter of less than about 1 mm. They are typically grouped together to form characters or other designs. Each perforation passes through both layers 12 and 14 with the result that the perforations are immediately visible when held up to a light. In the event of unauthorized opening of seam 16, it would be extremely difficult to reseal seam 16 without many of the perforations being out of alignment or blocked by adhesive. The integrity of the perforations, and thus of the contents of envelope 10, may be readily checked by a recipient by viewing seam 16 against a bright background.

Referring now to the use of envelope 10, a sender first inserts the documents or other contents to be sent into envelope 10 through open fourth edge 22. The sender then removes tear-off identification panel 30 (if used) and folds fold-over flap 24 sealing it to second layer 14 by use of tamper-evident, user-sealable adhesive seal 26. Envelope 10 is then sent by any regular mail or courier service. On receipt, a recipient checks the integrity of seams 16, 18 and 20, and of tamper-evident, user-sealable adhesive seal 26, thereby verifying that envelope 10 was not tampered with in transit.

A method of producing tamper-evident envelopes according to the present invention will now be described with reference to FIGS. 4 and 5. FIG. 4 shows a male embossing jaw 40 and a female embossing jaw 42 for use in the production of a tamper-evident seam 44 in an envelope 46 according to the present invention. Embossing jaws 40 and 42 feature a pattern 48 which extends along at least a part thereof. Preferably, pattern 48 is effectively continuous, meaning that gaps between adjacent parts of pattern 48 are limited to less than about 1 cm. Pattern 48 typically includes a series of characters making up one or more words. The characters are preferably of non-standard designs in order to make forgery difficult. Additionally, or alternatively, pattern 48 includes one or more non-alphanumeric design. Pattern 48 extends along a length of embossing jaws 40 and 42 which corresponds to a major part of the intended length of tamper-evident seam 44. Typically, pattern 48 extends along substantially the entire length of embossing jaws 40 and 42.

FIG. 5 shows part of embossing jaws 40 and 42 enlarged, thereby illustrating the form taken by pattern 48 on each jaw. On male embossing jaw 40, pattern 48 is implemented as a series of projections 50, whereas female embossing jaw 42 is provided with a series of sunken recesses 52 complementary to projections 50. When embossing jaws 40 and 42 are pressed together with one or more sheets of paper-containing material between them, projections 50 engage sunken recesses 52 thereby embossing pattern 48 through the paper-containing material.

Although jaws 40 and 42 have been described as embossing jaws, it should be understood that the same structure may be used additionally, or alternatively, for creating a perforated pattern. To form perforations, projections 50 take the form of blunt pins 54, and sunken recesses 52 take the form of complementary holes 56. In the case that pattern 48 includes perforated holes, jaws 40 and 42 may be described as perforating jaws.

To produce tamper-evident seam 44, a first and a second layer of paper containing material are positioned against each other along an edge where a seam is required. Glue is then introduced between the layers along the edge. Before the glue sets, the first and second layers are pressed together firmly between embossing jaws 40 and 42 along the entire length of the edge. This produces a copy of pattern 48 in both layers of paper-containing material along a major part of the length of the edge to form a tamper-evident seam 44. Where embossing is used, the embossing serves to interlock the layers as described above. Both embossing and perforation, individually or used in combination, make it extremely difficult to reseal seam 44 undetectably, as described above.

Preferably, an irreversibly thermoset glue is used. This typically requires the embossing to be completed within about 20 seconds from the application of the glue. Once the glue has set, the embossed copy of pattern 48 becomes rigidly fixed, thereby making it infeasible to open seam 44 without causing visible damage to envelope 46. The glue is preferably chosen such that it is insoluble in most common solvents, or such that any solvents capable of dissolving the set glue are likely to cause visible damage or staining to the material of envelope 46.

It should be understood that the entire process of manufacture of tamper-evident envelopes according to the present invention it typically totally automated, and may be performed using an apparatus adapted from conventional machines used in envelope production. The apparatus requires a mechanism for preparing and applying an appropriate type of glue, and for positioning the envelope correctly between automated pairs of embossing jaws. Preferably, the apparatus also includes a mechanism for attaching a tamper-evident, user-sealable adhesive strip or the like for a user to seal the envelope, and a mechanism for printing on the envelope instructions for the sender and/or recipient relating to security precautions. The details of the mechanisms required for these and all other features of an apparatus for producing tamper-evident envelopes according to the present invention will be readily understood by one familiar with the art through analogy to conventional techniques.

It should be understood that the method of producing tamper-evident envelopes according to the present invention may be varied in various ways. One variation of particular interest involves the use of laminated sheets of paper. Two sheets of paper laminated with a thermosettable polymer are positioned with the polymer layers abutting. The embossing and or perforating is then performed with heated jaws, thereby simultaneously fusing and thermosetting the two layers of polymer lamination to form a seam 44. This technique does not require the addition of additional glue, thereby simplifying the production process.

Figure 6:
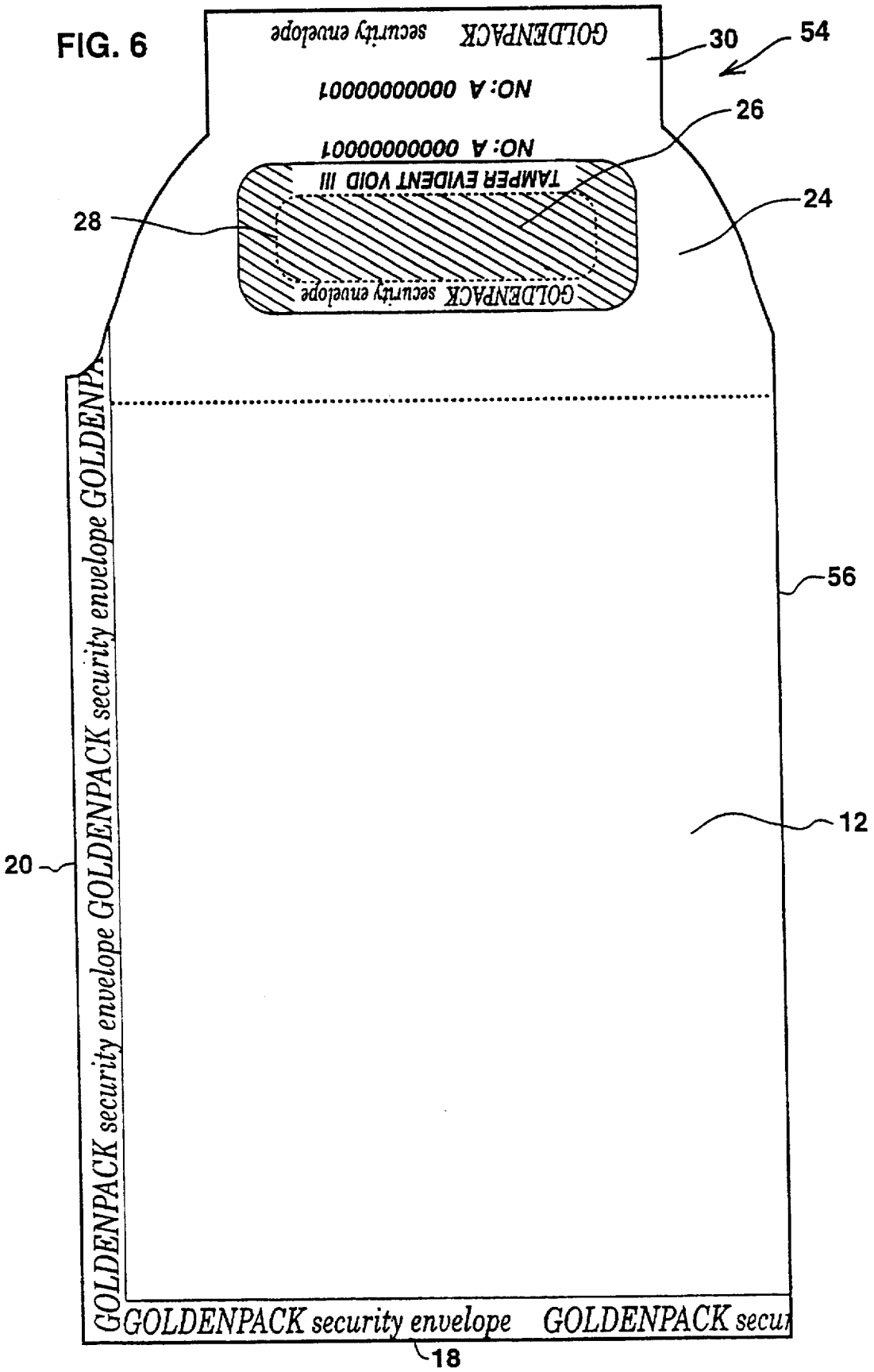
FIG. 6 is a top view of a second embodiment of a tamper-evident envelope, constructed and operative according to the teachings of the present invention.

Finally, and with reference to FIG. 6, it is noted that tamper-evident envelopes according to the present invention, and methods for their production, may readily be adapted to a wide variety of types of envelope. For example, envelopes with irregular, multi-faceted or curved seams may be produced for specific applications. Thus, in certain cases, tamper-evident envelopes according to the present invention have only a single curved seam, for example, a semi-circular seam, with the remaining perimeter of the envelope constituting the user-sealable section. Rectangular envelopes, which are of more general utility, may also vary widely both in size and in design.

FIG. 6 shows a second embodiment of a tamper-evident envelope, generally designated 54, constructed and operative according to the teachings of the present invention. Tamper-evident envelope 54 is generally similar to tamper-evident envelope 10, and equivalent features are labelled similarly. Tamper-evident envelope 54 differs from tamper-evident envelope 10 in that first layer 12 and second layer 14 are formed from a single sheet of paper-containing material folded so as to form a first edge 56 of tamper-evident envelope 54. First layer 12 and second layer 14 are attached to each other along two of the remaining edges by seams 18 and 20 to form a substantially rectangular enclosure.

It will be appreciated that the above descriptions are intended only to serve as examples, and that many other embodiments are possible within the spirit and the scope of the present invention.

What is claimed is:

1. A method of producing a tamper-evident envelope, the method comprising the step of sealing a first layer of paper-containing material to a second layer of paper-containing material along at least one edge to form a tamper-evident seam, said step of sealing including:

(a) positioning said first layer against said second layer along said at least one edge; and (b) pressing together said first layer and said second layer along said at least one edge between a male embossing jaw and a female embossing jaw, said male and female embossing jaws being formed so as to produce a tamper-evident seam having an pattern including a plurality of dissimilar embossed elements embossed through both said first and second layers, said pattern extending along a major part of said at least one edge.

2. The method of claim 1, wherein said male and said female embossing jaws include perforating features such that said step of pressing together produces a tamper-evident seam which includes a pattern of perforations through said first and second layers.

3. The method of claim 1, wherein said step of positioning is performed with a glue interposed between said first layer and said second layer along said at least one edge.

4. The method of claim 1, wherein said first layer and said second layer each include a polymer lamination, said step of positioning being performed such that said polymer lamination of said first layer abuts said polymer lamination of said second layer, said male embossing jaw and said female embossing jaw being heated such that said step of pressing together causes fusing of said polymer lamination of said first layer with said polymer lamination of said second layer.

5. The method of claim 1, wherein said step of sealing is performed along a first substantially straight edge, a second edge substantially parallel to said first edge, and a third edge substantially perpendicular to, and substantially connecting between, said first and second edges, thereby defining a substantially rectangular tamper-evident envelope having a fourth edge which is to be sealed by a user.

6. The method of claim 5, wherein said first layer extends beyond said second layer at said fourth edge thereby forming a fold-over flap, the method further comprising the step of providing a tamper-evident, user-sealable means for attaching said fold-over flap to said second layer.

7. The method of claim 1, wherein said first and second layers are formed by folding a single sheet of paper-containing material thereby defining a first edge of the tamper-evident envelope along which said first and second layers are joined at a fold, said step of sealing being performed along a second edge substantially perpendicular to, and substantially connecting to, said first edge, and a third edge substantially perpendicular to, and substantially connecting to, one out of said first and said second edges, thereby defining a substantially rectangular tamper-evident envelope having a fourth edge which is to be sealed by a user.

8. The method of claim 7, wherein said first layer extends beyond said second layer at said fourth edge thereby forming a fold-over flap, the method further comprising the step of providing a tamper-evident, user-sealable means for attaching said fold-over flap to said second layer.

9. A method of producing a tamper-evident envelope, the method comprising the step of sealing a first layer of paper-containing material to a second layer of paper-containing material along at least one edge to form a tamper-evident seam, said step of sealing including:

(a) positioning said first layer against said second layer along said at least one edge; and (b) pressing together said first layer and said second layer along said at least one edge between a male perforating jaw and a female perforating jaw, said male and female perforating jaws being formed so as to produce a tamper-evident seam having a pattern including a plurality of dissimilar sub-patterns, each of said sub-patterns being made up of holes perforated through both said first and second layers, said pattern extending along a major part of said at least one edge.

10. The method of claim 9, wherein said male and said female perforating jaws include embossing features such that said step of pressing together produces a tamper-evident seam which includes a pattern embossed through said first and second layers.

11. The method of claim 9, wherein said step of positioning is performed with a glue interposed between said first layer and said second layer along said at least one edge.

12. The method of claim 9, wherein said first layer and said second layer each include a polymer lamination, said step of positioning being performed such that said polymer lamination of said first layer abuts said polymer lamination of said second layer, said male embossing jaw and said female embossing jaw being heated such that said step of pressing together causes fusing of said polymer lamination of said first layer with said polymer lamination of said second layer.

13. A tamper-evident envelope comprising:

(a) a first layer of paper-containing material; and (b) a second layer of paper-containing material attached to said first layer along at least one seam, wherein said at least one seam includes a pattern along a major part of said at least one seam, said pattern including a plurality of dissimilar embossed elements embossed through both said first and second layers so as to render said pattern resistant to forgery.

14. The tamper-evident envelope of claim 13, wherein said pattern further includes a sub-pattern of holes perforated through both said first and second layers.

15. The tamper-evident envelope of claim 13, wherein the tamper-evident envelope is substantially rectangular having a first edge, a second edge, a third edge and a fourth edge, said at least one seam extending along a major part of each of said first, second and third edges.

16. The tamper-evident envelope of claim 15, wherein said first layer extends beyond said second layer at said fourth edge thereby forming a fold-over flap, the tamper-evident envelope further comprising a tamper-evident, user-sealable means for attaching said fold-over flap to said second layer.

17. The tamper-evident envelope of claim 13, wherein the tamper-evident envelope is substantially rectangular having a first edge, a second edge, a third edge and a fourth edge, said first and second layers being formed from a single sheet of paper-containing material folded along said first edge, said at least one seam extending along a major part of each of said second and third edges.

18. The tamper-evident envelope of claim 17, wherein said first layer extends beyond said second layer at said fourth edge thereby forming a fold-over flap, the tamper-evident envelope further comprising a tamper-evident, user-sealable means for attaching said fold-over flap to said second layer.

19. The tamper-evident envelope of claim 13, wherein said plurality of dissimilar embossed elements is implemented as a sequence of characters forming a word.

20. The tamper-evident envelope of claim 13, wherein said plurality of dissimilar embossed elements includes a non-alphanumeric design.

21. A tamper-evident envelope comprising:

(a) a first layer of paper-containing material; and (b) a second layer of paper-containing material attached to said first layer along at least one seam, wherein said at least one seam includes a pattern along a major part of said at least one seam, said pattern including a plurality of dissimilar sub-patterns, each of said sub-patterns being made up of holes perforated through both said first and second layers, so as to render said pattern resistant to forgery.

22. The tamper-evident envelope of claim 21, wherein said pattern further includes at least one embossed element embossed through both said first and second layers.

* * * * *